US006817797B1

(12) United States Patent
Liu

(10) Patent No.: US 6,817,797 B1
(45) Date of Patent: Nov. 16, 2004

(54) MULTI-COLOR PEN SET

(76) Inventor: Chen Chou Liu, PO Box 82-144, Taipei (TW)

( * ) Notice: Subject to any disclaimer, the term of this patent is extended or adjusted under 35 U.S.C. 154(b) by 0 days.

(21) Appl. No.: 10/702,467

(22) Filed: Nov. 7, 2003

(51) Int. Cl.[7] ..... B43K 27/04
(52) U.S. Cl. ..... 401/35; 401/34
(58) Field of Search ..... 401/34, 35, 48, 401/16, 17, 23

(56) References Cited

U.S. PATENT DOCUMENTS 1,938,835 A * 12/1933 Grzyb ..... 401/35
3,164,906 A * 1/1965 Andaloro ..... 33/41.4
4,120,595 A * 10/1978 Moreno ..... 401/35
5,306,092 A * 4/1994 Jenq ..... 401/47

* cited by examiner

*Primary Examiner*—David J. Walczak
(74) *Attorney, Agent, or Firm*—Leong C. Lei

(57) ABSTRACT

An improved structure of a multi-color pen set essentially comprised of base, penholder, multiple cartridges containing colors different from one another, and upper lid; multiple insertion holes being provided on the base to each receiving and holding in position a pen point; a retainer being provided above the base; multiple sleeves in parallel being provided to the retainer, and a retaining wall being provided on the upper edge of the sleeves in parallel; multiple cartridges being inserted and held in position by the sleeves, then further placed in the penholder to separate from one another by means of the retainer to prevent contacts among the cartridges and to allow easier assembly of the pen set.

1 Claim, 4 Drawing Sheets

MULTI-COLOR PEN SET

BACKGROUND OF THE INVENTION (a) Technical Field of the Invention

The present invention is related to an improved structure of a multi-color pen set, and more particularly, to one that allows easier and faster assembly and prevents contamination of color among the cartridges.

(b) Description of the Prior Art

Either in painting or plotting, color pens are a must in the modern life. To produce even more versatile changes in colors, a multi-color pen set having containing multiple cartridges containing various colors in the same penholder has been developed. The multicolor pen set of the prior art though eliminates the flaw of being monotonous observed in the conventional color pen, it prevents easy assembly by having multiple color cartridges into the same penholder, and those cartridges containing different colors from one another are vulnerable to be mutually contaminated one another one due to vibration or other factors, thus to affect the quality of the color pen set.

SUMMARY OF THE INVENTION

The primary purpose of the present invention is to provide an improved structure of a multiple color pen set that allows easier assembly and prevents contamination among those multiple color cartridges for upgrading the quality of the multi-color pen set.

To achieve the purpose, the lower end of each cartridge is inserted into a sleeve provided to a retainer and the upper end is inserted and held position into an upper lid so that all the color cartridges are held in position before being inserted into a penholder for easier and faster assembly for upgrading the production efficiency.

The foregoing object and summary provide only a brief introduction to the present invention. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
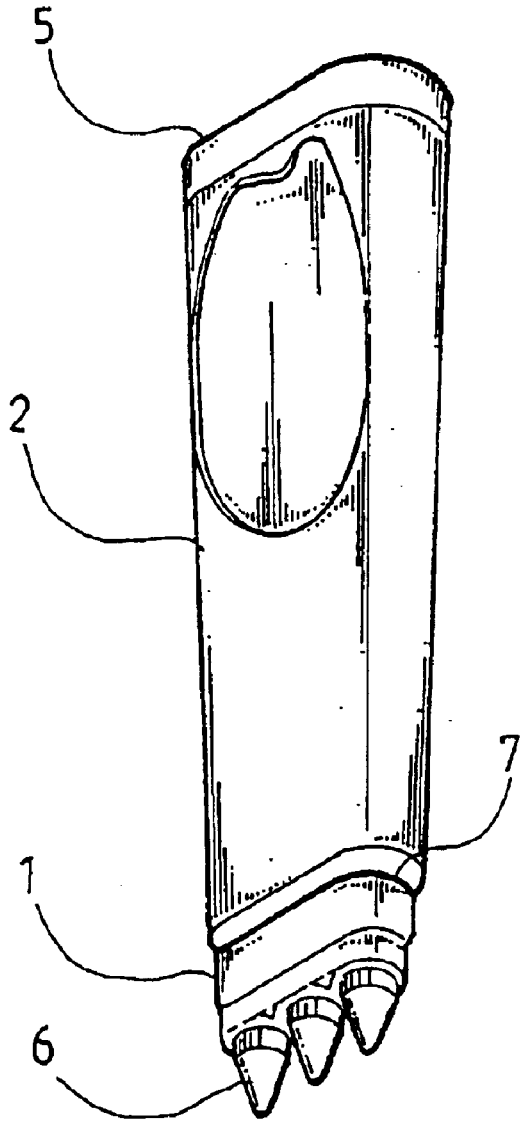
FIG. 1 is a perspective view of the present invention.
Figure 2:
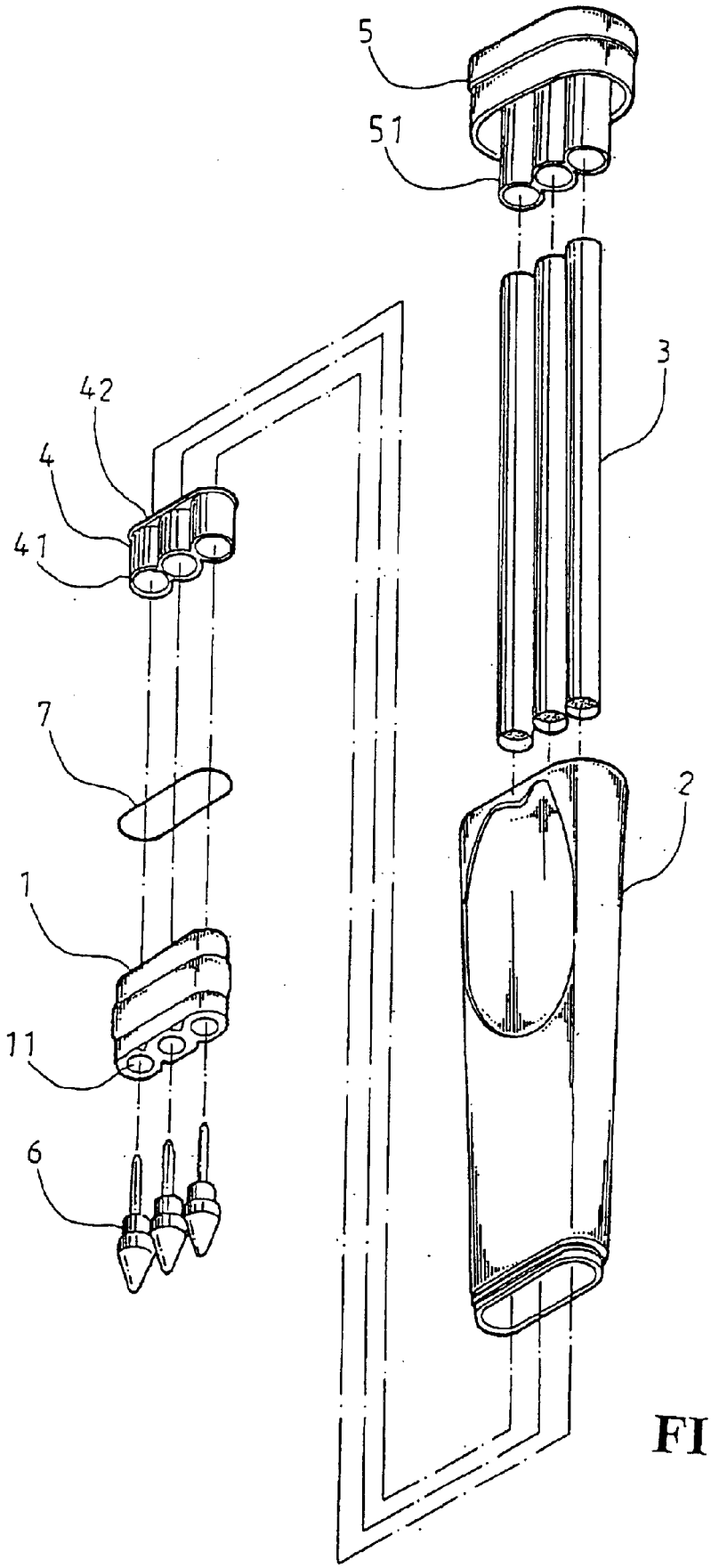
FIG. 2 is an exploded view of the present invention.

Referring to FIGS. 1 and 2, the present invention is essentially comprised of a base 1, a penholder 2, and multiple color cartridges containing colors different from one another, a retainer 4, and an upper lid 5. Wherein, multiple insertion holes 11 are provided on the base 1 for each to receive and hold in position a pen point 6 while multiple sleeves 51 in relation to those insertion holes 11 are provided on the upper lid 5.

A unit containing multiple hollow sleeves 41 in the same number as that of those insertion holes 11 on the base 1 are provided to the retainer 4 and arranged in parallel to one another, and a retaining wall 42 is provided on the upper edge of the unit of those sleeves 41.

When assembled, those cartridges 3 are having their upper ends inserted and held in position to the unit of those multiple sleeves 51 provided on the upper lid 5 and having their lower ends inserted and held in position into the unit of those hollow sleeves 41. Those multiple cartridges 3 when held in position are placed into the penholder 2, and then the base 1 containing those multiple pen points 6 is inserted into the bottom of the penholder 2. A waterproof washer 7 is provided at where between the penholder 2 and the base 1 to complete the assembly of a multi-color pen set that can draw multiple colors at the same time.

Whereas the upper end and the lower end of each color cartridge 3 being held in position respectively by those sleeves 51 provided to the upper lid 5 and the unit of those hollow sleeves 41 provided to the retainer 4, it allows easier assembly, and permits those color cartridges 3 to separate from one another to prevent mutual contamination of colors among one another to affect the quality of the multi-color pen set.

Figure 3:
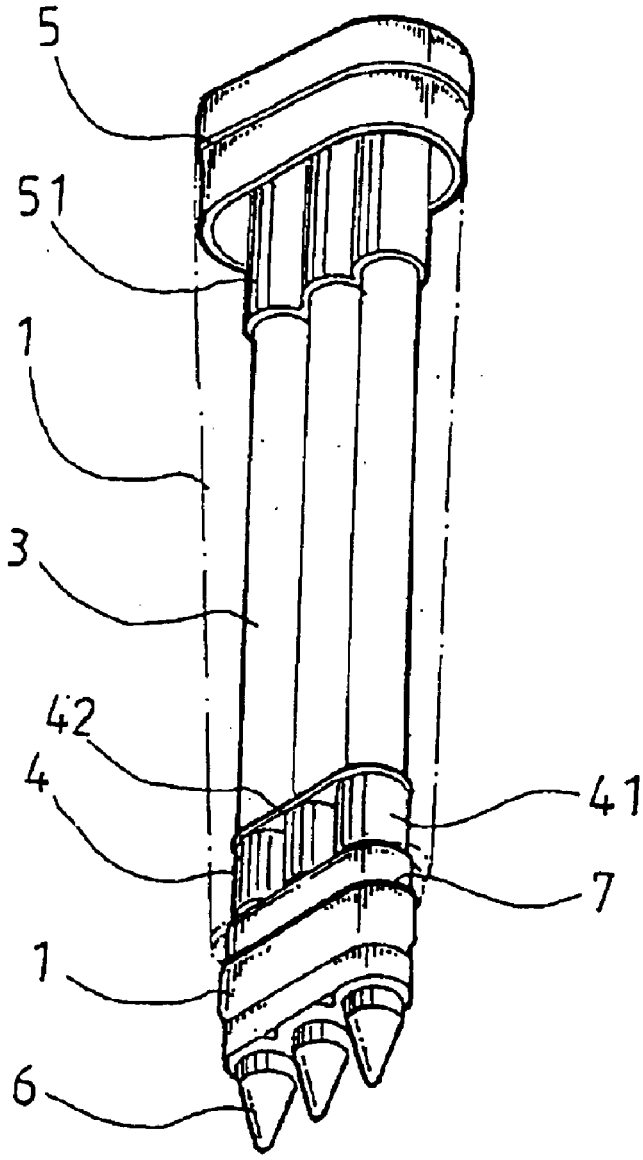
FIG. 3 is a schematic view showing an assembly of multiple cartridges of the present invention.

As illustrated in FIG. 3, those multiple color cartridges 3 held in position to the upper lid 5 and the retainer 4 are placed into the penholder 2 with the retainer 4 placed at where above the base 1 for each pen point 6 to hold against each cartridge 3 to force the ink to flow out of the pen point 5 in drawing the strokes in various colors. Whereas it is not necessarily to position those multiple color cartridges 3 one by one; instead, it takes only to insert those multiple color cartridges 3 into the upper lid 5 and the retainer 4 to permit easy and fast assembly for upgrading production efficiency.

Figure 4:
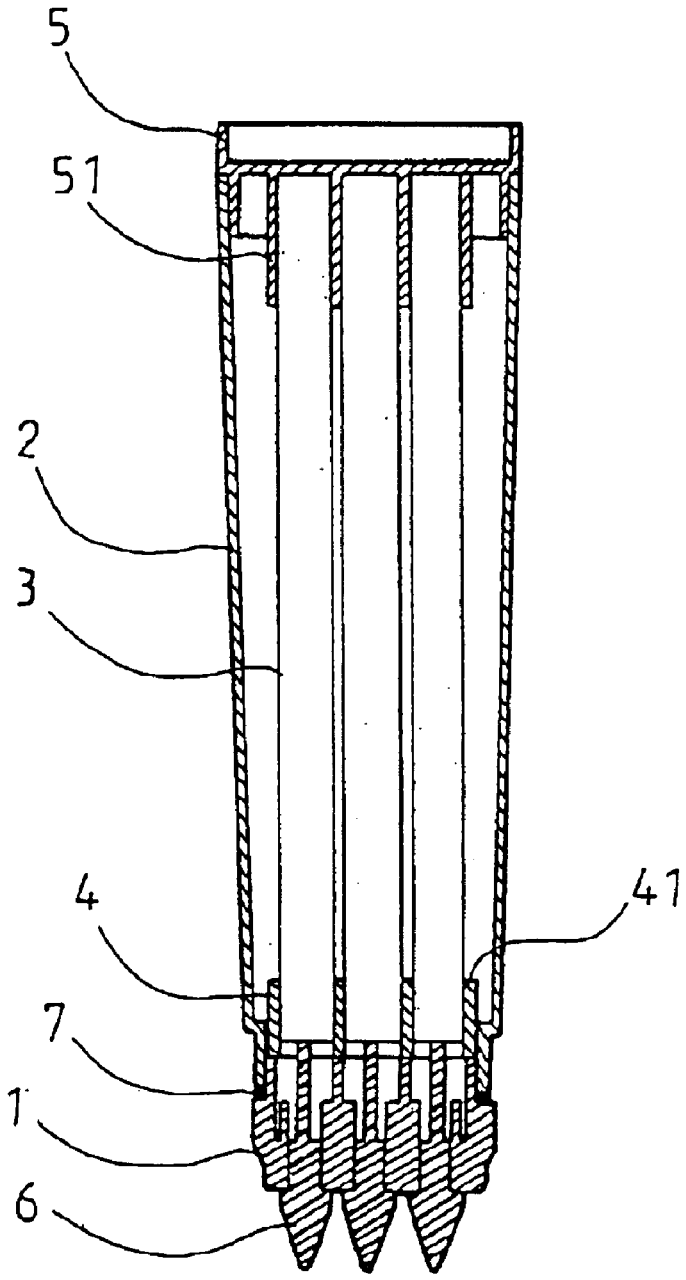
FIG. 4 is a sectional view of the present invention.

Now referring to FIG. 4, whereas those color cartridges 3 are held in position at their upper and lower ends respectively by those sleeves 51 provided to the upper lid 5 and the unit of multiple hollow sleeves 41 provided to the retainer 4, they are prevented from contacting one another no matter how the entire penholder is shaken so to prevent from mutual contamination for assurance of the quality of the multi-color pen set.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-color pen set comprising:

a base having a plurality of insertion holes;

a retainer having a plurality of hollow sleeves and arranged on a top of said base, said hollow sleeves being in alignment with said insertion holes;

a penholder having a lower end engaged with an upper end of said base;

a waterproof washer mounted between said lower end of said penholder and said upper end of said base;

a plurality of cartridges inserted into said penholder and having lower ends each extending through a respective one of said hollow sleeves of said retainer;

a plurality of pen points each inserted into a respective one of said insertion holes; and an upper lid engaged with an upper end of said penholder and having multiple sleeves each adapted to receive an upper end of a respective one of said cartridges.

* * * * *